United States Patent [19]

Avaiusini

[11] 4,031,720

[45] June 28, 1977

[54] LOCKING DEVICE FOR SECURING SKIS

[76] Inventor: Mauricio V. Avaiusini, 1038 S. 317th St., Federal Way, Wash.

[22] Filed: Nov. 24, 1975

[21] Appl. No.: 634,403

[52] U.S. Cl. ..... 70/58; 70/451; 280/11.37 K

[51] Int. Cl.[2] ..... E05B 73/00; A63C 11/00

[58] Field of Search ..... 70/57, 58, 59, 61, 62, 70/364 R, 451, 100, 370; 211/4, 60 SK, 7; 280/11.37 E, 11.37 K, 11.37 A; 24/221 K; 292/58, 62

[56] References Cited

UNITED STATES PATENTS

| | | | |
|---|---|---|---|
| 200,319 | 2/1878 | Ludlow | 70/451 |
| 1,529,071 | 3/1921 | Leach | 70/370 |
| 2,956,812 | 10/1960 | Lundquist | 211/60 SK |
| 3,171,182 | 3/1965 | Danehy | 24/221 K |
| 3,636,739 | 1/1972 | Smedley | 70/58 |

FOREIGN PATENTS OR APPLICATIONS

| | | | |
|---|---|---|---|
| 1,512,617 | 1/1968 | France | 70/58 |
| 741,678 | 5/1943 | Germany | 70/59 |

*Primary Examiner*—Paul R. Gilliam
*Assistant Examiner*—Kenneth J. Dorner
*Attorney, Agent, or Firm*—Graybeal, Barnard & Uhlir

[57] ABSTRACT

A locking device for a pair of skis having a first and second attachment mountable on respective skis. The first attachment includes a locking bolt which is positioned flush with the underside of the ski in a retracted position and is projected substantially beyond the underside of said ski in an extended position. A head portion of the lock bolt is received through an orifice of a second attachment and includes a lock surface for mating with end wall surrounding the orifice. The lock bolt head is rotated to a locked position by a lock means which is operated by a tumbler. A bolt is threadably received into an opening formed from the upper to the lower surface of each ski and provides a mounting for a housing portion of each attachment.

4 Claims, 9 Drawing Figures

LOCKING DEVICE FOR SECURING SKIS

BACKGROUND OF THE INVENTION

1. Field of the Invention

This invention relates to a locking device securing a pair of skis and, more particularly, to a pair of locking attachments for a pair of skis which are fixedly attached near opposite ends securing the skis against theft.

2. Description of the Prior Art

Both U.S. Pat. No. 3,742,740 granted July 3, 1973 to Edwald Pyzell and U.S. Pat. No. 3,739,606, granted June 19, 1973 describe the growing problem of the theft of skis at ski resorts and similar places. They describe how the owners of skis frequently leave their skis unattended outside a ski lodge or other similar place for limited periods of time. With the increasing number of skiers it has become much easier for a thief to carry off such an unattended pair of skis unnoticed by the true owner.

Examples of heretofore known devices for securing a pair of skis together are described in U.S. Pat. No. 3,636,739, granted Jan. 25, 1972, to Richard Smedley; German Pat. No. 2,003,966, granted Aug. 19, 1971; Swiss Pat. No. 133,497, granted Aug. 16, 1929 and Norwegian Pat. No. 70,431, granted May 13, 1946. These devices require a detachable portion of the ski lock device be carried by the skier in order to secure the skis during periods of non-use. These detachable portions are often bulky, hard to actuate, and can involve extensive manipulation of the skis and/or cooperating portions to engage the mating components. Additionally, these prior art devices are difficult for a skier to actuate whose dexterity has been hindered by the lower temperature often prevailing while skiing.

As is well known to most skiers, it is highly desirable to transport the skis from one location to another bound together by devices known per se. An example of such would be a simple stretchable strap with hooks at each end. Many of the prior art locking devices require a skier to carry another device to hold the skis together during transporting in addition to the locking device employed in an anti-theft device. Accordingly, the owner of a pair of skis is put to the additional expense and inconvenience of obtaining and using an extra device solely for holding the skis together when not in use.

SUMMARY OF THE INVENTION

The present invention relates to a locking pair of first and second attachements fixedly positioned near opposite ends of a pair of skis for securing the skis against theft.

According to an aspect of the invention, an anti-theft device is provided which secures a pair of skis to a fixed structure. The device includes a pair of first and second attachments fixedly mounted on a pair of skis near opposite ends. Each first attachment includes a lock bolt movable between a retracted position in which it is flush with the underside of a ski and an extended position in which it projects substantially beyond the underside of the ski. Each second attachment includes a locking device for receiving the lock bolt in its extended position. A tumbler member operates the locking device between a locked position in which the lock bolt is engaged in the locking device and an unlocked position in which the lock bolt is released.

According to an aspect of the invention, a first attachment is mountable on a ski and cooperates with a second attachment on the other ski to secure the skis together. The first attachment includes a lock bolt which is movable axially between a retracted position in which the lock bolt is flush with the underside of a ski an extended position in which the lock bolt projects substantially beyond the underside of the ski. The lock bolt is engaged by the second attachment on the other ski thus securing the skis together.

According to another aspect of the invention, a second attachment is mountable on a ski and cooperates with first attachment to secure the skis together. The second attachment includes a locking device which is attached to one ski for receiving an extended portion of the first attachment mounted on the other ski. A tumbler member operates the locking device between a locked position in which the lock bolt extending from the first attachment is held within the second attachment and an unlocked position in which the lock bolt is released.

According to another aspect of the invention, a thumb button on a first attachment mounted on a ski is depressed to extend a lock bolt from the lower surface of the ski which can be engaged in a second attachment on the opposite ski for securing the skis together.

In accordance with another aspect of the invention, a first and second attachment for locking a pair of skis together each including a mounting bolt which is initially threaded into an opening from the upper to the lower surface of each ski. The remaining portions of each attachment can then be fixedly attached to the mounting bolt positioning each assembly on the upper surface of respective skis.

According to yet another aspect of the invention, a first and second attachment for locking a pair of skis together are mountable at any point along the longitudinal axis of a pair of skis. The end of the shank is positionable flush with the underside of its ski by a washer located between the upper surface of the ski and the mounting bolt.

In accordance with still another aspect of the invention, a first and second attachment for locking a pair of skis together are affixed to respective skis by initially positioning a mounting bolt at any desired point along the longitudinal axis of the ski. The mounting bolt includes a spigot portion with an attached shank which is initially threaded into an opening from the upper to the lower surface of each ski. The end of the shank is positioned substantially flush with the underside of the ski by selecting a washer of the desired thickness. The remaining portion of each attachment can then be secured on the upper surface of the ski.

In view of the foregoing, it is an object of this invention to provide a locking device for a pair of skis which is extremely simple to actuate but yet is very strong and durable in construction.

It is another object of the invention to provide a locking device which can be used to secure numerous different types of skis such as those used in snow skiing or water skiing.

It is another object of the invention to provide a ski lock attachment which is secured to each ski without exposed pins, screws or the like.

It is still another object of the invention to provide a ski lock attachment which can be mounted at any desired point along the lonngitudinal axis of a ski.

It is yet another object of the invention to position a ski lock attachment flush with the underside of respective skis.

It is yet another object of this invention to provide an anti-theft device for a pair of skis which also holds the skis with their lower surfaces juxtapositioned for convenient transportation.

Still another object of the invention is to provide a locking device for securing a pair of skis which is adapted to fit a number of different types and sizes of ski by the selection of the correct mounting points along the longitudinal axis of a ski for a first and second attachment.

It is yet another object of the present invention to provide a locking device for securing a pair of skis which can be actuated in a few seconds time.

It is still another object of the invention to provide a locking device for a pair of skis which remains fixedly attached to the upper surface of each ski so that no detachable components must be carried by a skier.

Other and additional advantages will be apparent from the following description taken in conjunction with the accompanying drawings.

DETAILED DESCRIPTION OF THE PREFERRED EMBODIMENT

Figures 1, 2:
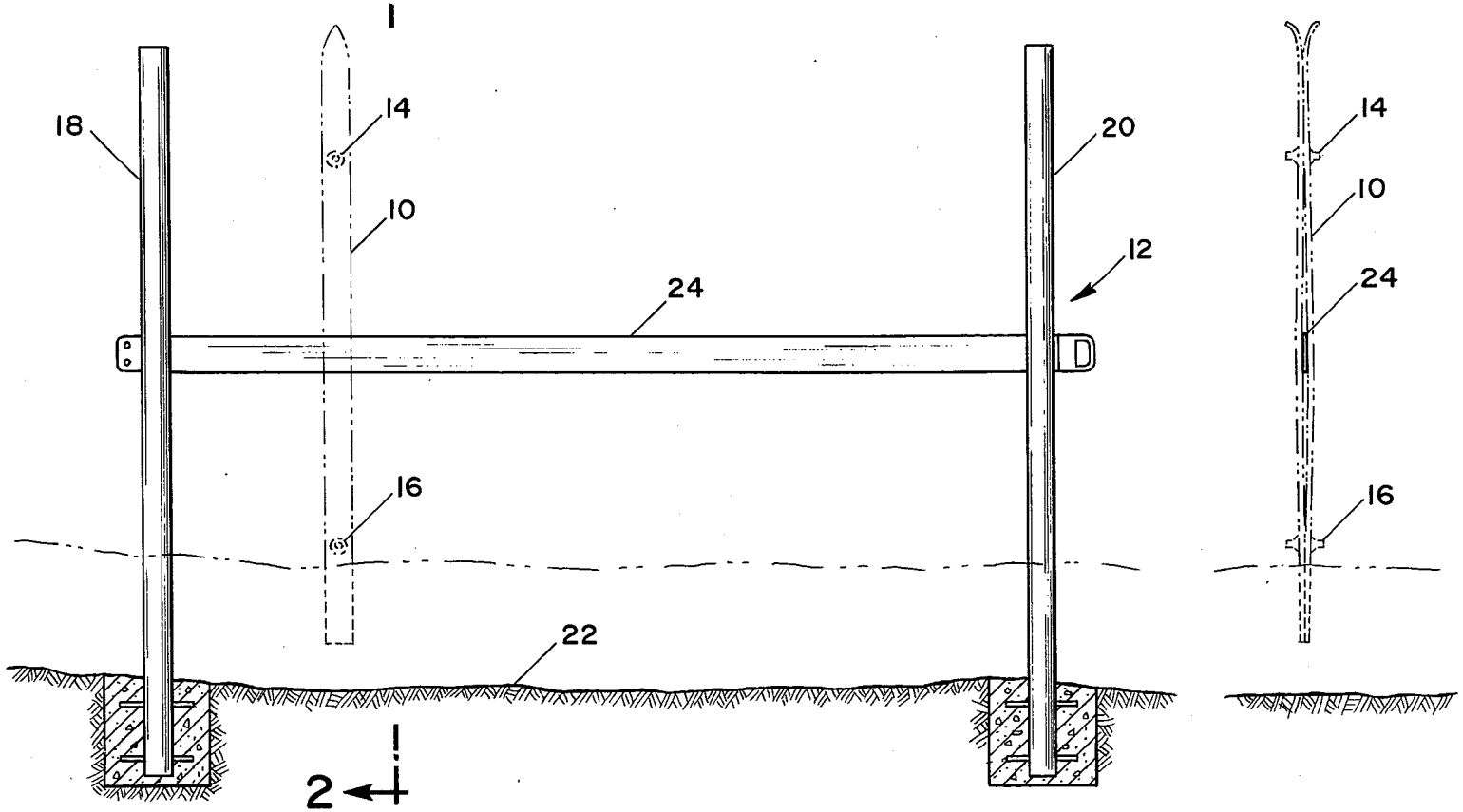
FIG. 1 is an elevational view showing a typical pair of skis secured to a ski rack by the ski lock device according to the instant invention.
FIG. 2 is an end view taken along lines 2—2 of FIG. 1, showing a pair of skis locked together with an elongated rail extending horizontally between the arcuate portion of the ski.

Referring initially to FIGS. 1 and 2, a typical pair of skis 10 is shown secured to a ski rack 12 by a pair of locking devices 14 and 16 fixedly mounted to the skis near opposite ends. It is well known that skis 10 are not merely flat with elongated planar surfaces; but rather, they are relatively thick in cross-section near the mid-point where the binding (not shown) is attached and thinner near each end of the ski. Additionally, as can be best seen in FIG. 2, the skis viewed from a side are slightly bowed such that when a ski is placed against a planar surface the mid-point of the ski is slightly elevated. Thus, the novel locking device of this invention utilizes these variations in both thickness and shape to secure the lower surfaces of the skis together over a stationary ski rack.

Preferably, a typical ski rack used in conjunction with the locking assemblies according to the instant invention comprises a pair of upright poles 18 and 20 held firmly in a vertical position in ground 22. A horizontal rail 24 is slidably attached to the rigid poles allowing vertical movement with respect to the ground thereby compensating for varying snow depths. It could be expected that due to the simple construction and low cost, such ski racks could be found in many locations around a ski lodge.

Figures 3, 4, 5, 6:
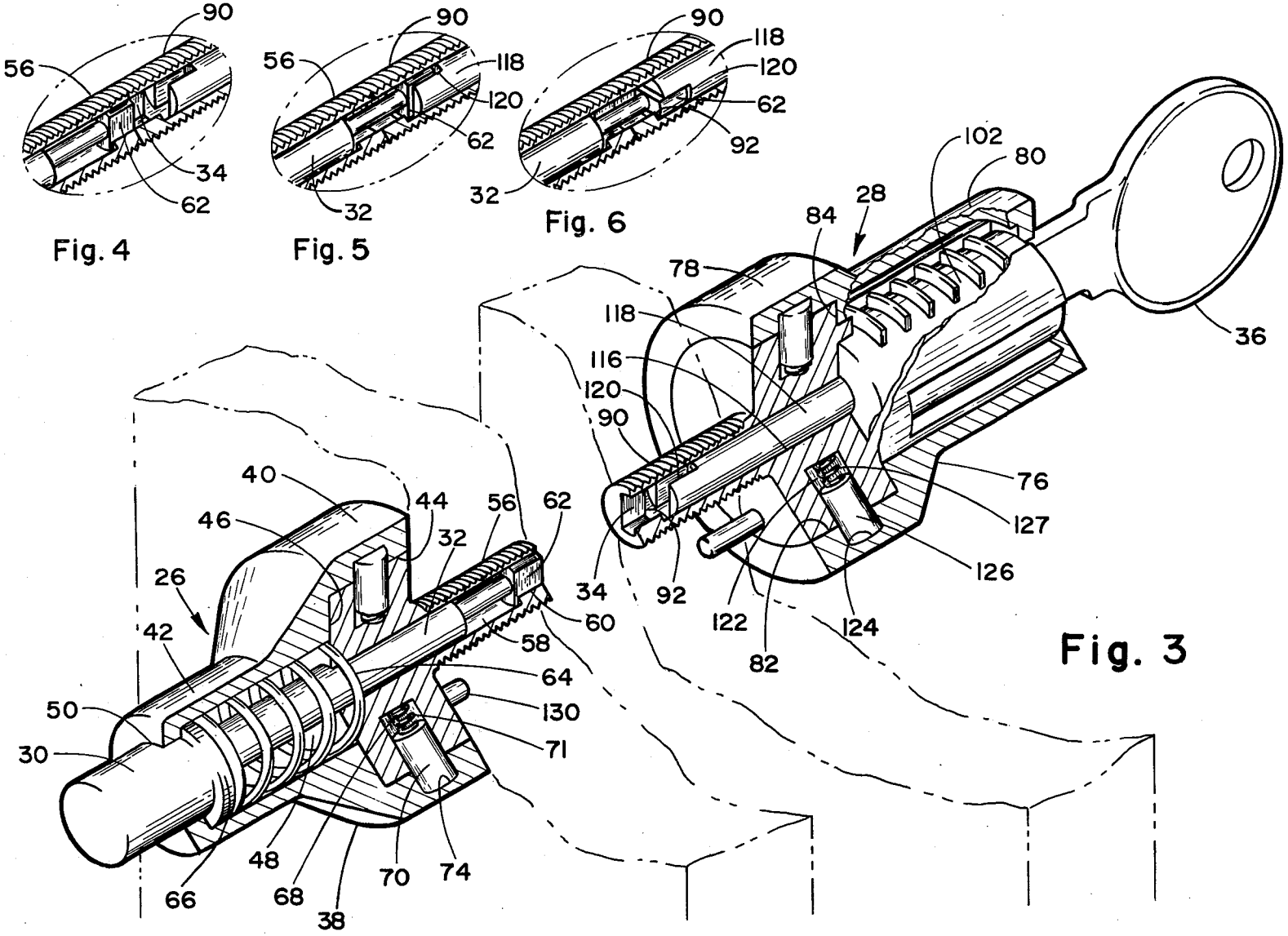
FIG. 3 is an enlarged pictorial view of a single ski lock device according to the instant invention depicted coaxially as mounted on a pair of skis and having cut away portions to show the internal components.
FIGS. 4, 5 and 6 are fragmented views of the inwardly facing shank portions of each locking device illustrating the locking sequence.

One of the two identical locking devices positioned near opposite ends of a pair of skis will now be described in conjunction with FIGS. 3 through 7. Referring initially to FIG. 3, a first attachment 26 and a second attachment 28 are shown fixedly mounted on respective skis. To secure skis 10 together, either for transporting or over a rail of a ski rack as previously described, the lower surfaces are juxtapositioned such that the first attachment 26 mounted on one ski and the second attachment 28 mounted on the other ski are coaxially aligned. A thumb button 30 protruding from an opening atop the first attachment 26 is depressed thereby extending a lock bolt 32 from the underside of its ski. In this extended position, lock bolt 32 is projected through orifice 34 of second attachment 28 coaxially mounted on the opposite ski. Key 36 is then inserted through an opening atop second attachment 28 and rotated 90° to the locked position and the key is withdrawn. The other locking device positioned near the opposite end of the ski can then be locked in an identical fashion. Preferably, a common key locks both assemblies so that only one key need be carried by a skier.

Additionally, if a single family has more than one skier and several pairs of skis, a common key could actuate the locking devices on all skis.

Figure 7:
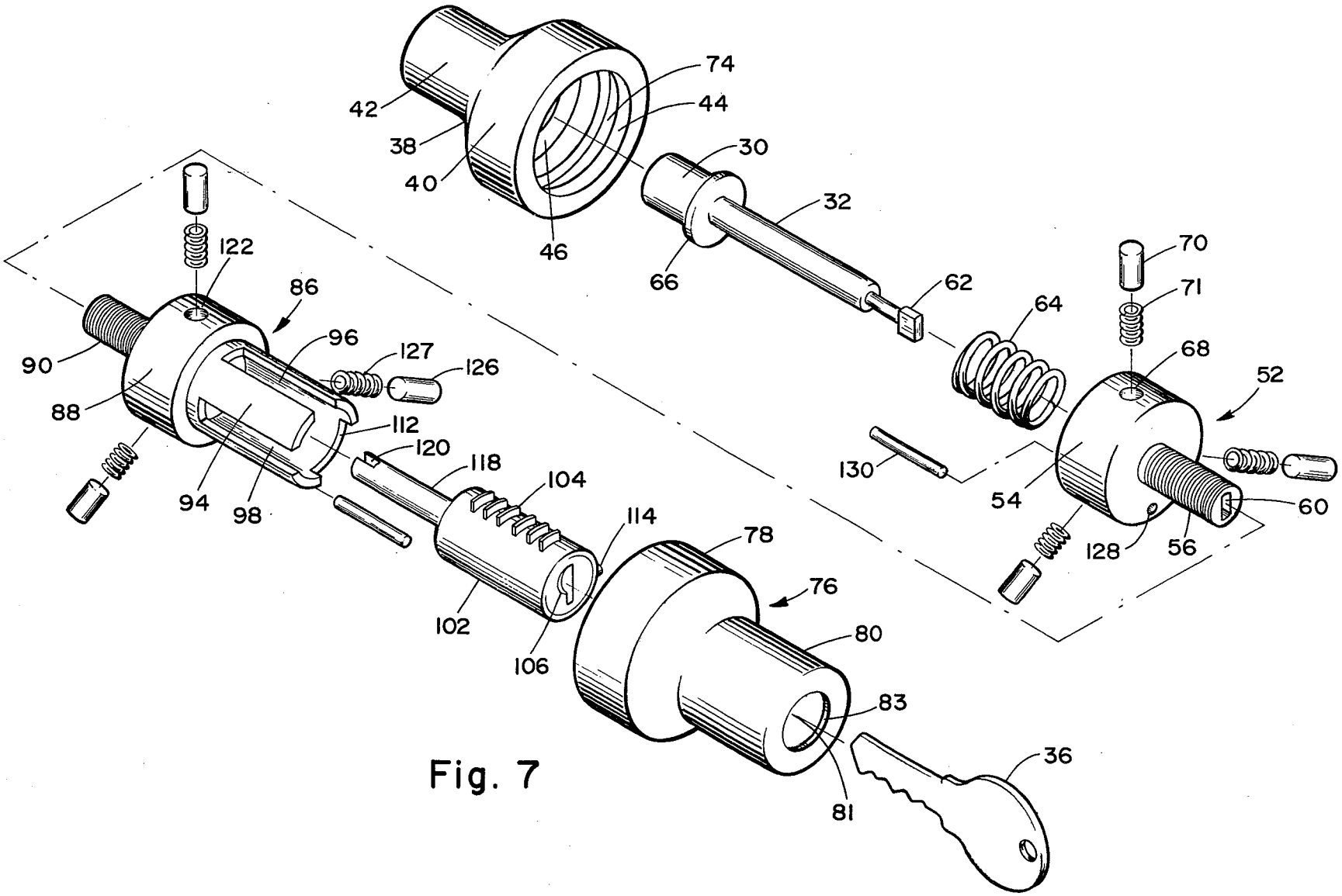
FIG. 7 is an exploded pictorial view of the locking assemblies according to the instant invention.

Referring now to FIG. 7 in conjunction with FIG. 3, the component parts of each locking device will now be described. Housing 38 of first attachment 26 is shown to comprise an enlarged outwardly opening cup-like portion 40 positioned adjacent to the upper surface of the ski and a lesser diameter cap 42. Interior side wall 44 and annular shoulder 46 are formed within cup-like portion 40. Spring cavity 48 extends axially through cap 42 and communicated with the interior of cup-like portion 40. An opening 50 is formed in the upper end wall of cap 42.

As can be best seen in FIG. 7, mounting bolt 52 has a circular head 54 with shank 56 extending axially from one end face. A passageway 58 (FIG. 3) is formed within and extends axially through shank 56 toward the end wall. An opening 60 is formed in the end wall of shank 56 and has a non-circular cross-section which substantially matches the extendible head portion 62 of lock bolt 32 in both size and cross-sectional configuration. Opening 60 is a guide for lock bolt 32 aligning lock bolt head 62 with orifice 34 on second attachment 28. Lock bolt 32 is slidably positioned within passageway 58 such that head 62 is substantially flush with the end wall surrounding guide 60. However, it should be understood that in the retracted position, head 62 could be positioned axially inward from the end wall surrounding opening 60. Spring member 64 is situated in spring chamber 48 contacting an end face of mounting bolt 52 and flange 66 fixedly attached to lock bolt 32. Spring 64 biases the lock bolt toward its retracted position in which flange 66 abuts the inner portion of the end wall of cap 42 adjacent opening 50.

Three radially extending sockets 68 are formed in the side wall of mounting bolt head 54 along a radial plane, preferably equally displaced about a central axis. Annular channel 74 (FIG. 7) is formed on inner side wall 44 of housing 38 and can be aligned with sockets 68 in mounting bolt 52. The width of annular channel 74 is substantially identical to the diameter of sockets 68. Detent members 70 are positioned in sockets 68 and are urged radially by spring 71 into annular channel 74. The side wall of detent members 70 engage both annular channel 74 and opening 68 thereby preventing axial movement of housing 38 with respect to mounting bolt 52. It should be understood that, although in preferred form three detent members are employed to prevent axial movement of housing 38 with respect to mounting bolt 52, any number of detent members could be used.

As previously described, to secure the skis 10 together a lock bolt 32 is extended from first attachment 26 and a head 62 is received in orifice 34 of second attachment 28. Key 36 can then be inserted into an opening atop the second attachment and rotated to a locked position. Referring again to FIG. 3 in conjunction with FIG. 7, a housing 76 of second attachment 28 is shown having an enlarged outwardly opening cup-like portion 78 and lesser diameter cap 80. A cavity 81 is formed within cap 80. The end wall of cap 80 is constructed with an opening 83 (FIG. 7) which communicates with cavity 81. An inner side wall 82 and annular shoulder 84 are formed within the interior of cup-like portion 78. Mounting bolt 86 includes a circular head 88 and an axially elongated shank 90 extending from one face of circular head 88. Orifice 34 is formed in the end wall of shank 90 and has a size and cross-sectional configuration which is at least slightly larger than lock bolt head 62. A locking surface 92 is provided on the inward end wall of shank 90 adjacent the inward opening of orifice 34. As is best seen in FIG. 7, a cylinder-like wall 94 extends axially from one face of mounting bolt head 88. A pair of rectangular slots 96 and 98 are formed in wall 94. A tumbler means comprises a rotor 102 and a plurality of tumblers 104 which extend radially from the side wall of the rotor. In a manner known per se, tumblers 104 are movable radially by the insertion of key 36 into an opening 106 at an end wall of tumbler body 102. As will be appreciated by those of ordinary skill, tumblers 104 are of a "normally extended" type such that prior to the introduction of key 36 into opening 106 all tumblers protrude from the rotor 102 to their maximum extent; and, subsequent to the introduction of key 36 into opening 106, all tumblers are retracted radially from their fully extended position. A recess 112 is formed in wall 94 which extends axially from the open end. A raidal protrusion 114 is fixedly attached to tumbler body 102 and is positioned to rotate in recess 112. The arcuate length of recess 112 is identical to the displacement of slots 96 and 98 on wall 94 so that tumblers 104 are aligned with slots 96 in the unlocked position and slot 98 in the locked position.

Referring again to FIG. 3, an axially extending passageway 116 is formed through mounting bolt 86 and communicates with orifice 34. A shaft 118 is fixedly attached to rotor 102 and extends into passageway 116. A wrench member 120 is provided at the end of shaft 118 and has a cross-sectional size slightly larger than head 62 of lock bolt 32. In the unlocked position, as depicted in FIG. 3, wrench member 120 is aligned with orifice 34 so that head 62 of lock bolt 32 can be slidably received therein.

In the same manner as described in conjunction with the first attachment and as is best seen in FIG. 7, three radially extending sockets 122 are formed in the side wall of mounting bolt head 88 along a radial plane, preferably equally displaced about the central axis. Annular channel 124 (FIG. 3) is formed on inner side wall 82 of cup-like portion 78 and can be aligned with sockets 122 in mounting bolt head 88. A detent member 126 is positioned in each socket 122 and is urged radially by spring 127 into annular channel 124. The side wall of detent member 126 engages both annular channel 124 and socket 122 thereby preventing axial movement of housing 76 with respect to mounting bolt 86. Accordingly, in the same manner as with the first attachment, it should be understood that, although in preferred form three detent members 126 are employed to prevent axial movement of housing 76 with respect to mounting bolt head 88, any number of detent members could be used.

As has been previously described, and is best depicted in FIG. 4, skis 10 are secured together by juxtapositioning their lower surfaces such that the shank portion 56 of first attachment 26 and shank 90 of second attachment 28 are coaxially aligned. Thumb button 30 is then depressed extending head 62 through orifice 34 positioned at the end of shank 90. Now referring to FIG. 5, it will be seen that head 62 is slidably received in wrench member 120. Next referring to FIG. 6, wrench member 120 is rotated to its locked position by rotor 102 (not shown) thereby engaging locking surface 92 on the inward side of lock bolt head 62. Accordingly, in this position lock bolt 32 is fixedly held within second attachment 28.

As previously mentioned, each attachment is firmly held adjacent to the upper surface of its respective ski by a mounting bolt. The positioning of mounting bolt 52 of first attachment 26 will now be described; however, it should be understood that the identical procedure is followed for mounting bolt 86 of second attachment 28. As depicted, mounting bolt 52 comprises a head portion 54 attachable to housing 38 and a shank 56 which extends axially from an end wall of mounting bolt 54. In mounting each attachment adjacent the upper surface of the respective skis, an opening is first formed from the upper to the lower surface of each ski by means of a conventional drill or another other well-known method. The opening is positioned along the longitudinal axis of the ski, preferably midway between either edge of the ski. As previously mentioned, the thickness of a ski along the longitudinal axis normally varies with the thinner portion being near either end. The point along the longitudinal axis for forming the opening is determined by ascertaining where the thickness of the ski corresponds to the length of the shank 56. Shank 56 is preferably externally threaded with conventional type threads. After the opening is formed, shank 56 is then threaded therein until head 54 is seated adjacent the upper surface of the ski. As best seen in FIG. 7, an opening 128 is formed through mounting bolt head 54 along an axis parallel to the central axis. After mounting bolt head 54 is seated adjacent the upper surface of the ski, a blind opening is formed in the ski along the same axis as opening 128 preferably also by a conventional drill. A locking pin 130 is then inserted in opening 128 so that the end extends into the blind opening in the ski thus preventing the mounting bolt from being unscrewed.

Figure 9:
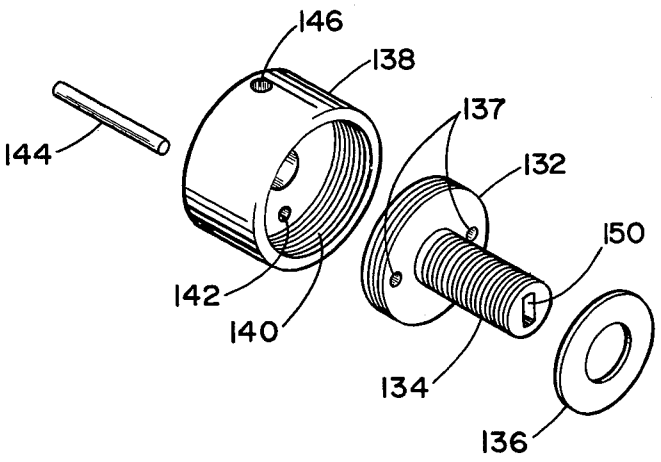
FIG. 9 is an exploded pictorial view of the mounting bolt illustrated in FIG. 8.
Figure 8:
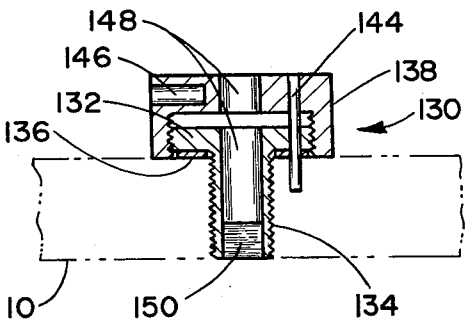
FIG. 8 is an axial sectional view of a second embodiment of a mounting bolt according to the instant invention.

Referring now to FIG. 8 in conjunction with FIG. 9, an alternative embodiment of mounting bolt 52 of first attachment 26 will now be described; additionally, it should be understood that these same features could also be used in an alternative embodiment for mounting bolt 86 of second attachment 28. This embodiment is particularly well suited for installation by a typical skier since it is easily adapted to various thicknesses of a pair of skis. Accordingly, the first and second attachment can be mounted at any preferred location along the longitudinal axis of a ski rather than the point where the length of the mounting bolt shank corresponds to the thickness of the ski. As illustrated, mounting bolt 130 comprises a spigot 132 and a shank 134 which extends axially from an end wall of spigot 132. In mounting each attachment adjacent the upper surface of its respective ski, an opening is first formed from the upper to the lower surface of each ski by means of a conventional drill or other well-known method. The opening is positioned generally midway between either edge of the ski at any point along the longitudinal axis of the ski. A conventional tap is used to form internal threads along the side wall of the opening. After the opening is threaded, a washer 136 is inserted over shank 134 which is then threaded into the opening formed from the upper to the lower surface of the ski. The thickness of the washer is selected so that the end of the shank is substantially flush with the underside of the ski. Of course, a single washer of the proper thickness or a plurality of thinner washers which together are of the proper thickness could be used. If desired, a pair of openings 137 could be formed along an axis parallel to the central axis through spigot 132 to act as wrench holes when threading shank 134 into the opening in the skis. As is best seen in FIG. 9, bell 138 of mounting bolt 130 is cup-like shaped having an internally threaded opening 140 at one end. The side wall of spigot 132 is externally threaded with a mating thread. Referring now to FIG. 8, after spigot 132 has been seated adjacent the upper surface of its ski with the end of shank 134 substantially flush with the underside of its ski, bell 138 is threaded onto spigot 132 until its end wall abuts the upper surface of the ski. Using preformed opening 142 as a guide, a hole is formed through spigot 132, washer 136 and partially into the ski along the guide axis by means of a conventional drill or the like. A locking pin 144 is then inserted through the aligned openings so that one end extends into the blind opening in the ski thereby preventing the entire assembly from being unscrewed. As has been previously described in conjunction with mounting bolt 52, three radially extending sockets 146 are formed in the side wall of the mounting bolt bell 138 along a radial plane, preferably equally displaced about a central axis. Detent members (not shown) are positioned in each socket and engage the annular channel of housing 38 (not shown) to prevent axial movement of the housing. Also in the same manner as described in conjunction with mounting bolt 52, a passageway 148 is formed in bell 138 and shank 134 to slidably receive the lock bolt. Accordingly, guide 150 at the end of shank 134 aligns lock bolt head 62 (not shown) for entry into the second attachment.

As has been described herebefore, the locking attachments according to the instant invention include respective mounting bolts with threaded shanks which are initially threadably received in openings formed from the upper to the lower surface of each ski. However, it should be understood that the mounting bolts could be affixed to each ski by other means such as gluing or the like. Additionally, it should be understood that the mounting bolts could be integrally formed during the manufacture of the ski so that the mounting bolt head is positioned adjacent the upper surface of the ski.

The invention may be embodied in other specific forms without departing from the spirit or central characteristics thereof. The present embodiments are therefore to be considered in all respects as illustrative and not restrictive, the scope of the invention being indicated by the appended claims rather than by the foregoing description, and all changes which come within the meaning and range of equivalency of the claims are therefore to be embraced therein.

What is claimed is:

1. Apparatus for locking a pair of skis together with their lower surfaces in juxtaposition, comprising:

a first attachment mountable onto an upper surface portion of one of said skis, comprising a lock bolt including a head portion having a non-circular cross-sectional configuration and axially inwardly directed lock surface means mounting means supporting said lock bolt for axial movement between a retracted position in which the head portion of said lock bolt is at least substantially flush with the underside of its ski, and an extended position in which the head of said lock bolt is positioned substantially beyond the underside of its ski, a second attachment mountable onto a corresponding upper surface portion of the second ski, including means defining an orifice having a cross-sectional shape which complements but is slightly larger than the cross-sectional shape of the head portion of the lock bolt, and lock surface means immediately inwardly bounding said orifice, said first attachment including means for moving said lock bolt axially from its retracted to its extended position, so that when said two attachments are on two skis whose lower surfaces are juxtposed and the head portion of said lock bolt is aligned with said orifice, said head portion can be moved axially through said orifice, and said second attachment including lock bolt rotation means for rotating said lock bolt in position after it has been extended through said orifice, to in that manner move the lock surface means on the head portion of said lock bolt angularly into a position of engagement with the lock surface means which inwardly bounds said orifice, whereby the engagement of the two lock surface means will prevent disengagement of said first and second attachments and in turn will prevent disengagement of the two skis, and for rotation of said lock bolt means back into a position in which its head portion is in pass-through alignment with said orifice, permitting separation of the two attachments and hence separation of the two skis, said lock bolt rotation means including a rotatable shaft having wrench means on an end thereof directed towards said orifice and sized to engage the head portion of said lock bolt, and key-controlled lock means connected to said shaft for controlling rotation of said shaft by operation of a key.

2. Apparatus according to claim 1, wherein said key-controlled lock means includes tumbler means comprising a rotatable body housing means defining a pair of angularly spaced apart axially extending slots radially outwardly bounding said rotatable body, and a plurality of radially extendible-retractable tumbler elements carried by said body, and extendible into one or the other of said slots, to lock said rotatable body against rotation, with one of said slots being positioned such that when the tumbler elements are located in it the wrench means at the end of said shaft is positioned to place the head portion of said lock bolt in pass-through alignment with the orifice in the second attachment, and with said second slot being oriented such that when the tumbler elements are in it, said wrench means is positioned to place the lock surface means on the head portion of said lock bolt in engagement with the lock surface means which inwardly bounds said orifice, and said key-controlled lock means including key means rotatable by a user for retracting the tumbler elements so that the rotatable body of said tumbler means can be rotated in position to move the tumbler elements from one slot to the other.

3. Apparatus according to claim 1, wherein said first and second attachments each includes an outer housing and a mounting bolt, each mounting bolt having a shank part adapted to fit into an opening therefore formed through a ski, between the upper and lower surfaces of the ski, and a head part connected to said shank part and adapted to project upwardly from the upper surface of the key when said shank part is located within the hole of the ski, and means for securing the outer housing to the head part of said mounting bolt.

4. Apparatus according to claim 3, wherein said means for securing said outer housing to the head part of said mounting bolt comprises at least one radially extending socket formed in said head portion, a spring located within said socket, and a detent member located within said socket radially outwardly of said spring, said spring serving to normally bias the detent member into a position wherein a substantial portion of it projects radially outwardly of said socket, and with said socket being deep enough so that the detent member can be moved radially into it by applying a force on it in opposition to the spring an amount sufficient to place its outer end at least flush with the open end of the socket, and wherein said outer housing includes means defining a radial recess positioned to receive the detent member, so that when the detent member is located within said radial recess it will serve to secure the outer housing to the head portion of the mounting bolt.

* * * * *